US009891029B2

(12) United States Patent
Oh

(10) Patent No.: US 9,891,029 B2
(45) Date of Patent: Feb. 13, 2018

(54) APPARATUS FOR COLLECTING WARHEADS

(71) Applicant: In Gyu Oh, Incheon (KR)

(72) Inventor: In Gyu Oh, Incheon (KR)

( * ) Notice: Subject to any disclaimer, the term of this patent is extended or adjusted under 35 U.S.C. 154(b) by 109 days.

(21) Appl. No.: 14/889,455

(22) PCT Filed: May 8, 2014

(86) PCT No.: PCT/KR2014/004057
§ 371 (c)(1),
(2) Date: Nov. 6, 2015

(87) PCT Pub. No.: WO2014/182071
PCT Pub. Date: Nov. 13, 2014

(65) Prior Publication Data

US 2016/0116260 A1 Apr. 28, 2016

(30) Foreign Application Priority Data

May 9, 2013 (KR) ..... 10-2013-0052560
May 9, 2013 (KR) ..... 10-2013-0052561
May 9, 2013 (KR) ..... 10-2013-0052562

(51) Int. Cl.
*F41J 13/00* (2009.01)

(52) U.S. Cl.
CPC ..... *F41J 13/00* (2013.01)

(58) Field of Classification Search
CPC ..... F41J 13/00; F41J 1/00; F41J 1/12
USPC ..... 273/410, 404
See application file for complete search history.

(56) References Cited

U.S. PATENT DOCUMENTS 4,445,693 A 5/1984 Angwin
4,819,946 A * 4/1989 Kahler ..... F41J 13/00 273/404
5,988,647 A 11/1999 Porter et al.
2011/0233870 A1* 9/2011 Oh ..... F41J 13/00 273/410
2012/0038110 A1 2/2012 Priebe et al.

FOREIGN PATENT DOCUMENTS

KR 10-1087283 B1 11/2011
KR 10-2012-0071200 A 7/2012

* cited by examiner

*Primary Examiner* — Aarti B Berdichevsky
*Assistant Examiner* — Christopher Glenn
(74) *Attorney, Agent, or Firm* — Novick, Kim & Lee, PLLC; Jae Youn Kim

(57) ABSTRACT

A bullet head-collecting apparatus capable of easily collecting bullet heads and of controlling the extent to which the force of impact is absorbed depending on the kind of bullet head is disclosed. The bullet head-collecting apparatus includes a case configured to have a hexahedral shape with open front and upper faces, a cover plate removably mounted on the open upper face of the case, a buffer unit disposed in the case so as to absorb the force of impact of a bullet head, and a bullet head impact control unit, which includes at least one pair of first fixed brackets internally mounted on both lateral side surfaces of the case in front of the buffer unit and at least one first bullet head control plate removably fitted into the pair of first fixed brackets.

7 Claims, 19 Drawing Sheets

APPARATUS FOR COLLECTING WARHEADS

TECHNICAL FIELD

The present invention relates to a bullet head-collecting apparatus, and more particularly to a bullet head-collecting apparatus, which is able to easily collect bullet heads used in shooting ranges, which have various diameters and are adapted for various kinds of bullets and to control the extent to which the force of impact of a bullet head is absorbed in accordance with the kind of bullet head.

BACKGROUND ART

In general, military and forces conduct target practice with personal firearms in order to develop marksmanship required in case of emergency, and to maintain combat skills. Such target practice using personal firearms is predominantly carried out indoors firing ranges or outdoors at zeroing firing ranges and actual distance shooting ranges. The bullet heads fired at such live firing ranges cause problems in that heavy metals contained in the bullet heads severely contaminate the surrounding environment and in that it is considerably difficult to dispose the bullet heads.

In particular, in the case of military forces, target practice using rifles such as M16 and K1 rifles is carried out at outdoor shooting ranges. At such military outdoor shooting ranges, since the ground or a hill is generally positioned behind targets, bullet heads fired from rifles are buried in the ground after passing through the targets. Consequently, military outdoor shooting ranges cause problems in that heavy metals contained in the bullet heads buried in the ground contaminate the surrounding soil and flow into nearby rivers, thereby contaminating the natural environment.

As solutions for solving the above problems, there is Korean Patent Registration No. 10-1087283, titled "bullet head-collecting apparatus", which was granted to the present applicant on Nov. 21, 2011. The construction of this invention will now be described with reference to FIGS. 22 and 23.

As shown in FIGS. 22 and 23, the conventional bullet head-collecting apparatus 100 includes a bullet head-collecting unit 1 for absorbing the kinetic energy of bullet heads and a bullet head discharging unit 2 for discharging the bullet heads that drop from the bullet head-collecting unit 1.

The bullet head-collecting unit 1 includes a plurality of absorption panels 12, which are fitted in sliding grooves 111 formed in side plates 11, which face each other, so as to absorb the kinetic energy in the flight direction of the bullet heads, and an escaping blocking panel 13 coupled to the rear ends of the side plates 11 so as to prevent the bullet heads from escaping the bullet head-collecting apparatus.

The side plates 11 are erected from both side edges of the body C, which are installed on the ground in such a manner as to face each other. The inner surfaces of the two side plates 11, which face each other, have symmetrically formed therein a plurality of vertical sliding grooves 111.

The plurality of absorption panels 12 are fitted in the sliding grooves 111 from the front end of the body, from which direction bullet heads fired from rifles approach. In other words, the plurality of absorption panels 12, which are sequentially fitted in the plurality of sliding grooves 111, constitute a block layer through which bullet heads penetrate.

Since the adjacent sliding grooves 111 are spaced apart from each other by a predetermined distance, the plurality of absorption panels 12 fitted in the sliding grooves 111 are also spaced apart from each other.

The absorption panels 12 are made of a material capable of absorbing the kinetic energy of a bullet head while the bullet head penetrates the absorption panels 12. By way of example, metal plates may be layered one on the other, or synthetic resin may be charged between the metal plates.

However, the conventional technology has the following problems.

Generally, bullet heads may have various diameters, and the amount of firing charge for propelling a bullet head may vary depending on the kind of bullet head. Even in the case of bullets of the same kind, the amount of firing charge contained in the bullets may be slightly different from each other.

Since the conventional bullet head-collecting apparatus includes a plurality of absorption panels, which are integrally constructed as a single set irrespective of such differences in diameter and amount of firing charge, the conventional bullet head-collecting apparatus has problems in that it is impossible to properly control the extent to which the force of impact is absorbed in the field in accordance with the varying force of impact of bullet heads caused by differences in the diameter and amount of firing charge thereof.

Accordingly, since it is impossible to properly absorb the force of impact in accordance with the varying force of impact of bullet heads caused by differences in the diameter and amount of firing charge thereof, the application of the bullet head-collecting apparatus is inevitably limited.

DISCLOSURE

Technical Problem

Therefore, the present invention has been made in order to overcome the above problems, and it is an object of the present invention to provide a bullet head-collecting apparatus, which is able to easily collect bullet heads used in shooting ranges, which have various diameters and are adapted for various kinds of bullets and to control the extent to which the force of impact of a bullet head is absorbed in accordance with the kinds of bullet heads.

It is another object of the present invention to provide a bullet head-collecting apparatus that easily and reliably absorbs the impact of bullet heads by virtue of a buffer unit constituted by filler.

It is still another object of the present invention to provide a bullet head-collecting apparatus, which enables a buffer unit to be more conveniently mounted and replaced by virtue of buffer blocks filled with filler.

It is yet another object of the present invention to provide a bullet head-collecting apparatus, which includes buffer blocks having through holes therein so as to efficiently absorb the force of impact of bullet heads and to reduce breakage of the buffer blocks caused by the force of impact of bullet heads.

It is still yet another object of the present invention to provide a bullet head-collecting apparatus, which contains filler added with a water absorption agent so as to efficiently prevent the filler from freezing and solidifying due to infiltration of moisture into the filler during the winter season.

It is a further object of the present invention to provide a bullet head-collecting apparatus, which includes a case having through holes therein and a cover plate having through holes therein so as to efficiently distribute the force of impact, applied to a buffer unit, to the outside.

It is another further object of the present invention to provide a bullet head-collecting apparatus, which includes a case having guide ribs and a cover plate having a guide rib so as to efficiently introduce bullet heads into the case.

Technical Solution

In order to achieve the above objects, "a bullet head-collecting apparatus" according to the present invention includes a case configured to have a hexahedral shape with open front and upper faces, a cover plate removably mounted on the open upper face of the case, a buffer unit disposed in the case so as to absorb the force of impact of a bullet head, and a bullet head impact control unit, which includes at least one pair of first fixed brackets internally mounted on both lateral side surfaces of the case behind the buffer unit and at least one first bullet head control plate removably fitted into the pair of first fixed brackets.

The bullet head impact control unit of "the bullet head-collecting apparatus" according to the present invention may include at least one pair of second fixed brackets internally mounted on both lateral side surfaces of the case behind the buffer unit, and at least one second bullet head control plate removably fitted into the pair of second fixed brackets.

The bullet head impact control unit of "the bullet head-collecting apparatus" according to the present invention may further include a bullet head-blocking plate, which is made of a metal material and is removably fitted in the pair of second fixed brackets behind the second bullet head control unit.

The buffer unit of "the bullet head-collecting apparatus" according to the present invention may include a pair of first fixed plates, which are attached to the inner surface of the case and are spaced apart from each other, and filler charged between the pair of fixed plates so as to absorb the force of impact of a bullet head.

The buffer unit of "the bullet head-collecting apparatus" according to the present invention may include a pair of second fixed plates, which are attached to an inner surface of the case and are spaced apart from each other, and one or more hexahedral buffer blocks, which are removably stacked between the pair of second fixed plates and are filled with filler.

The buffer unit of "the bullet head-collecting apparatus" according to the present invention may further include a plurality of through holes formed in upper and lower walls of the buffer blocks.

The filler of "the bullet head-collecting apparatus" according to the present invention may include rubber chips, sand, metal powder and water absorption agent.

The case of "the bullet head-collecting apparatus" according to the present invention may include a plurality of first through holes formed in regions of both lateral side walls and the lower wall of the case that are in close contact with the buffer unit, wherein the cover plate may include a plurality of second through holes formed in a region thereof that is in close contact with the buffer unit.

The case of "the bullet head-collecting apparatus" according to the present invention may include side guide ribs, which are symmetrically disposed at front ends of both lateral side walls of the case and are inclined inwards, wherein the cover plate may include an upper guide rib, which is disposed at the front end of the cover plate and is inclined inwards.

The case of "the bullet head-collecting apparatus" according to the present invention may further include a pair of side bulletproof covers, which are symmetrically attached to both lateral side walls of the case so as to cover the side guide ribs, wherein the cover plate may further include an upper bulletproof cover attached the an upper wall of the cover plate so as to cover the upper guide rib 22.

"The bullet head-collecting apparatus" according to the present invention may include a target attaching plate, which is made of a flexible material and is attached to the front surface of the bullet head impact control unit 40, which is disposed at the open front face of the case.

The case of "the bullet head-collecting apparatus" according to the present invention may include a discharge opening formed in the lower wall of the case behind the buffer unit, wherein the bullet head-collecting apparatus may further include a collecting drawer slidably mounted on a support frame disposed at the lower wall of the case, and a plurality of legs mounted on the support frame.

"The bullet head-collecting apparatus" according to the present invention may further include a support unit, which is disposed on the front surface of the buffer unit in the case so as to support the front surface of the buffer unit.

The support unit of "the bullet head-collecting apparatus" according to the present invention may include a rectangular frame, which is closely mounted on the periphery of the front surface of the buffer unit, a horizontal support, which is attached to both lateral sides of the rectangular frame such that they extend horizontally and inwardly and have ridges that protrude forward, and a vertical support, which is attached between upper and lower ends of the rectangular frame and which has a ridge that protrudes forward.

Advantageous Effects

As described above, the present invention is able to easily collect bullet heads used in shooting ranges, which have various diameters and are used for various kinds of bullets and to control the extent to which the force of impact of bullet is absorbed in accordance with the kind of bullet head, whereby the range of applicability of the apparatus is remarkably widened and the convenience in use thereof is remarkably improved.

Furthermore, the present invention easily and reliably absorbs the impact of bullet heads by virtue of a buffer unit constituted by filler.

Furthermore, the present invention enables a buffer unit to be more conveniently mounted and replaced by virtue of buffer blocks filled with filler.

Furthermore, the present invention includes buffer blocks having through holes therein so as to efficiently absorb the force of impact of bullet heads and to reduce breakage of the buffer blocks caused by the force of impact of bullet heads, thereby remarkably extending the service life.

Furthermore, the present invention contains filler added with water absorption agent so as to efficiently prevent the filler from freezing and solidifying due to the infiltration of moisture into the filler during the winter season, thereby efficiently preventing the apparatus from becoming inoperable due to the freezing of the filler.

Furthermore, the present invention includes a case having through holes therein and a cover plate having through holes therein so as to efficiently distribute the force of impact, applied to a buffer unit, to the outside, thereby extending the service life of the case.

Furthermore, the present invention includes a case having guide ribs and a cover plate having a guide rib so as to efficiently introduce bullet heads into the case, thereby more reliably collecting bullet heads and remarkably reducing damage to the case.

BEST MODE

Figure 1:
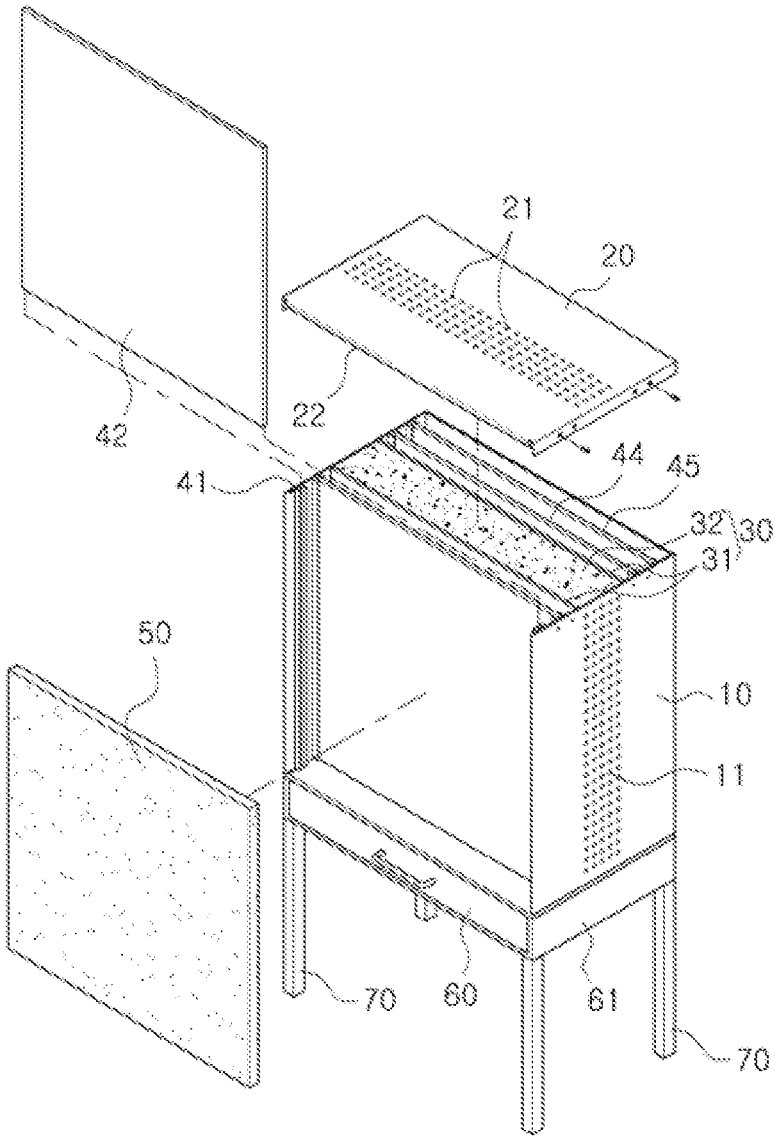
FIG. 1 is a partially exploded perspective view of a bullet head-collecting apparatus according to a first embodiment of the present invention.
Figure 2:
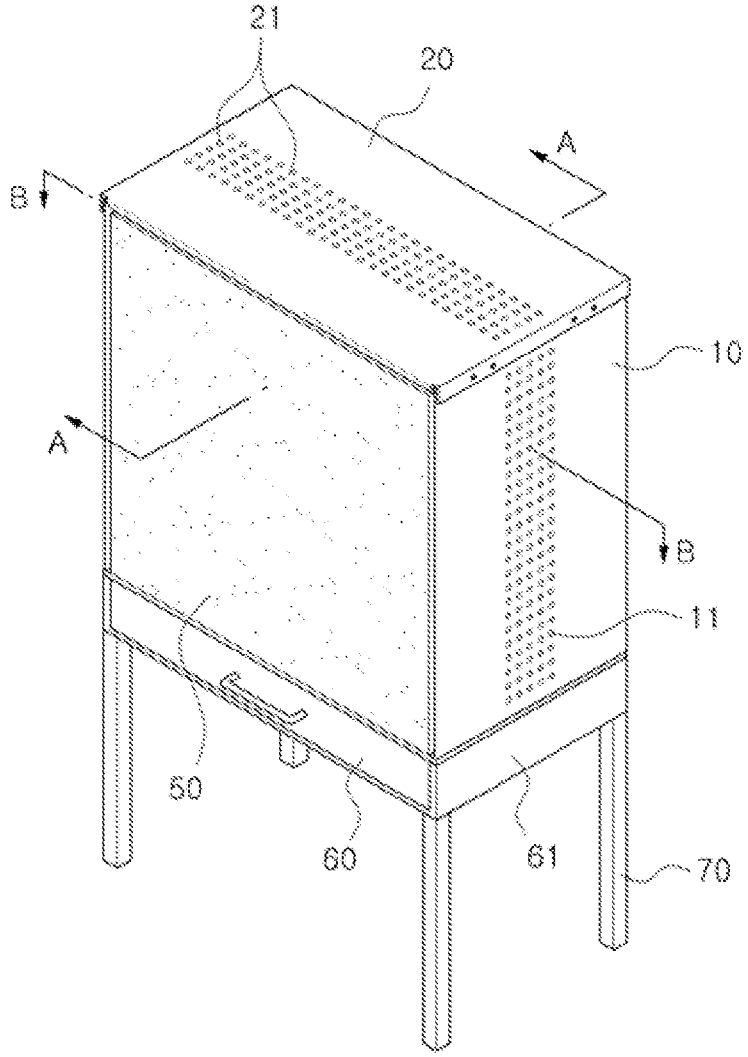
FIG. 2 is an assembled perspective view of the bullet head-collecting apparatus according to the first embodiment of the present invention.
Figure 3:
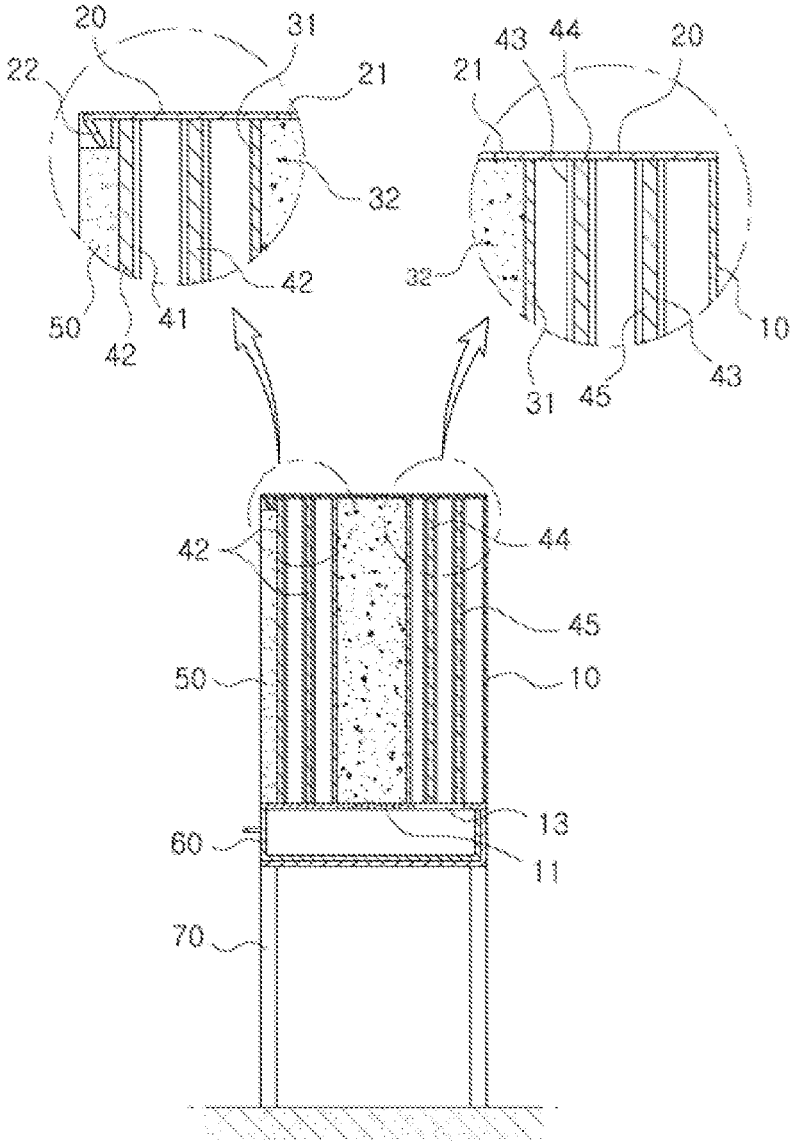
FIG. 3 is a schematic cross-sectional view taken along line A-A of FIG. 2.
Figure 4:
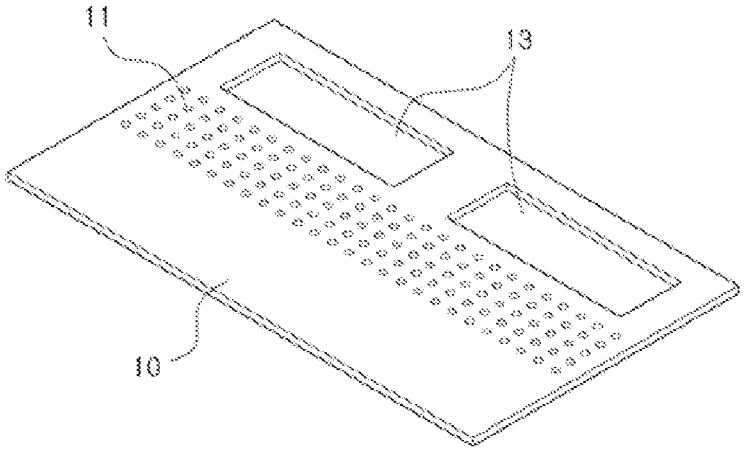
FIG. 4 is a schematic cross-sectional view taken along line B-B of FIG. 2.
Figure 5:
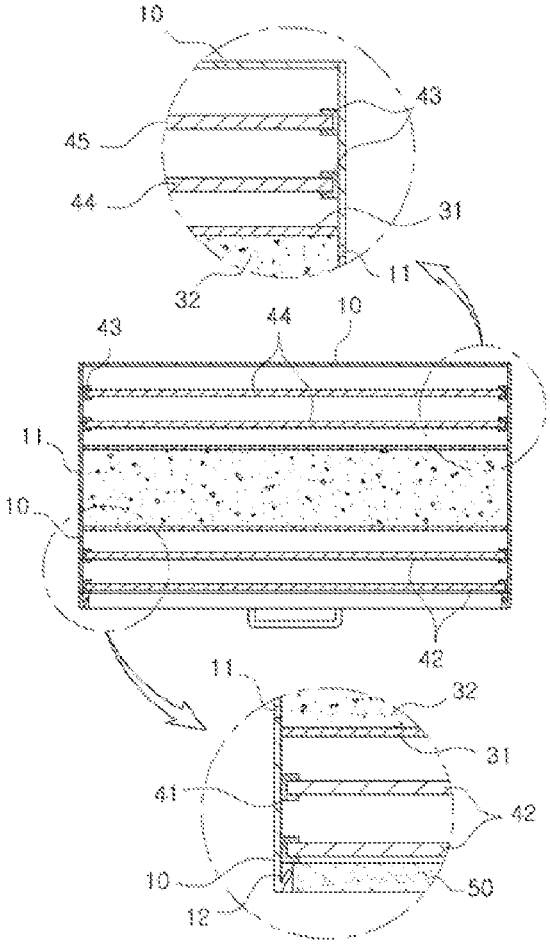
FIG. 5 is a perspective view showing a lower wall of a case of the bullet head-collecting apparatus according to the first embodiment of the present invention.

Hereinafter, preferred embodiments of the present invention will be described in detail with reference to the accompanying drawings. It is to be noted that various changes and modifications may be made in the invention and the present invention is not limited to the embodiments.

As shown in FIGS. 1 to 5, a bullet head-collecting apparatus according to a first embodiment of the present invention includes a case 10, a cover plate 20 covering the case 10, a buffer unit 30 disposed in the case 10, and a bullet head impact control unit 40 disposed in the case 10 near the buffer unit 30.

The case 10 is configured to have a hexahedral shape with open upper and front faces. The case 10 provides a space for accommodating various components including the buffer unit 30 and serves to collect bullet heads, which are shot horizontally and introduced into the case 10. The case 10, which fulfills such a function, is preferably made of metal plates that cannot be perforated by the bullet heads.

The case 10 further includes a plurality of first through holes 11 formed in the regions of both lateral side walls and a lower wall thereof that are in close contact with the buffer unit 30. The first through holes 11 are intended to efficiently distribute the force of impact applied to the buffer unit 30 by a bullet head.

The case 10 further includes side guide ribs 12, which are symmetrically formed at the front ends of both lateral side walls thereof and which are inclined inwards. The side guide ribs 12 serve to guide bullet heads, which are introduced through the open front face of the case 10, toward the inside of the case 10 so as to prevent the bullet heads from being deviated outside of the case 10.

The case 10 further includes discharge openings 13 formed in the lower wall thereof behind the buffer unit 30. The discharge holes 13 serve as outlets through which bullet heads collected in the case 10 are discharged downwards from the case 10 (see FIG. 5).

The cover plate 20, which is detachably mounted on the open upper face of the case 10, serves to open and close the upper face of the case 10. Specifically, the cover plate 20 is separated from the case 10 so that the case 10 can be opened when desired by the user, whereby the user can easily control the absorption of impact by the bullet head impact control unit 40.

The cover plate 20 further includes a plurality of second through holes 21 formed in the region of the cover plate 20 that is in close contact with the buffer unit 30. Like the first through holes 11, the second through holes 21 are intended to efficiently distribute the force of impact applied to the buffer unit 30 by a bullet head, and are intended to allow relatively fine particulate filler 32, for example, sand or metal powder, to be additionally charged in the buffer unit 30 without requiring a user to dismantle the cover plate 20.

The cover plate 20 further includes an upper guide rib 22, which is formed at the front end thereof and is inclined inwards and downwards. Like the side guide ribs 12, the upper guide rib 22 serves to guide bullet heads, which are introduced through the open front face of the case 10, toward the inside of the cover plate 20, that is, the inside of the case 10 so as to prevent the bullet heads from being deviated outside of the case 10.

The buffer unit 30, which is disposed in the case 10, serves to absorb the force of impact of bullet heads introduced into the case 10.

The buffer unit 30, which fulfills such a function, includes a pair of first fixed plates 31, which are attached to the inner surface of the case 10 in the state of being spaced apart from each other, and filler 32, which is charged between the pair of first fixed plates 31 so as to absorb the force of impact of bullet heads.

The first fixed plates 31 serve to provide a space in which the filler 32 is charged. The first fixed plates 31, which fulfill such a function, are attached to both lateral inner surfaces of the case 10 through welding or are fixedly mounted on the lateral inner surfaces by means of brackets.

The filler 32 serves to immobilize a bullet head, which is introduced into the case 10 through the front one of the pair of fixed plates 31, and to absorb the force of impact of the bullet head. The bullet head having lost the force of impact while passing through the filler 32, penetrates the rear one of the pair of fixed plates 31, and is collected in the rear space of the case 10.

The filler 32, which fulfills such a function, includes rubber chips, sand, metal power and water absorption agent. The rubber chips, which are prepared by finely crushing rubber waste such as waste tires into chips having a predetermined size, serves to elastically hold bullet heads.

The sand and metal powder are mixed with the rubber chips, and also serve to hold bullet heads so as to decrease the speed of bullet heads.

The water absorption agent, which is constituted by a chemical material, for example, silica gel, which absorbs moisture infiltrated into the filler 32, serves to absorb moisture contained in the filler 32 so as to prevent the filler 32 from freezing due to moisture during the winter season.

Specifically, the filler 32 solidifies into a rigid solid due to moisture contained in the filler 32 when the temperature goes down during the winter season, whereby bullet heads cannot be held by the filler 32. In order to solve the problem caused by freezing of the filler 32, the water absorption agent is added to the filler 32.

The bullet head impact control unit 40, which is disposed in the case 10 near the buffer unit 30, serves to provide a function of controlling the absorption of the force of impact of bullet heads as intended by a user, in addition to the function of absorbing the impact of bullet heads by the buffer unit 30.

The bullet head impact control unit 40, which fulfills such a function, includes a plurality of first holding brackets 41, which are internally mounted in pairs on both lateral side surfaces of the case 10 in front of the buffer unit 30, and a plurality of first bullet head control plates 42, which are releasably fitted between the respective pairs of first holding brackets 41.

The first holding brackets 41 serve to releasably hold the first bullet head control plates 42 in the case 10 in front of the buffer unit 30.

The first bullet head control plates 42 serve to absorb the force of impact of a bullet head to some degree before the bullet head enters the buffer unit 30. Although the first bullet head control plates 42, which fulfill such a function, are preferably made of a synthetic resin material such as PET, which has low stretchability and high toughness, the present invention is not limited thereto. The first bullet head control plates 42 may be made of various materials capable of absorbing the force of impact of a bullet head while the bullet head passes through the first bullet head control plates 42.

Although two first bullet head control plates 42 are illustrated in the drawings, the first bullet head control plates 42 may be provided in a number greater than two. The absorption of the force of impact of bullet heads may be controlled by a user by fitting the first bullet head control plates 42 between the pairs of first holding brackets 41 or removing the first bullet head control plates 42 therefrom depending on the kind of bullet head or bullet. The first bullet head control plates 42 serves to fulfill a function of additionally absorbing the force of impact of bullet heads, in addition to the absorption of the force of impact obtained by the buffer unit 30.

In other words, when the force of impact of bullet heads can be completely absorbed by the buffer unit 30, all of the first bullet head control plates 42 are removed. Meanwhile, when the force of impact of bullet heads cannot be completely absorbed by the buffer unit 30, the first bullet head control plates 42 are appropriately mounted so as to further absorb the force of impact of bullet heads.

Accordingly, by controlling the number of first bullet head control plates 42 that are mounted, depending on the kind of bullet head or bullet, various kinds of bullet heads can be collected by the bullet head-collecting apparatus.

The bullet head impact control unit 40 further includes a plurality of second holding brackets 43, which are internally mounted in pairs on both lateral side surfaces of the case 10 behind the buffer unit 30, and a plurality of second bullet head control plates 44, which are releasably fitted between the respective pairs of second holding brackets 43.

Like the first holding brackets 41, the second holding brackets 43 serve to releasably hold the second bullet head control plates 44 in the case 10 behind the buffer unit 30.

The second bullet head control plates 44 serve to further absorb the force of impact of a bullet head to some degree after the bullet head has entered the buffer unit 30. Although the second bullet head control plates 44, which fulfills such a function, are preferably made of a synthetic resin material such as PET, which has low stretchability and high toughness, the present invention is not limited thereto. The second bullet head control plates 44 may be made of various materials capable of absorbing the force of impact of a bullet head while the bullet head passes through the second bullet head control plates 44.

Although only one second bullet head control plate 44 is illustrated in the drawings, the second bullet head control plate 44 may be provided in a number greater than one. The absorption of the force of impact of bullet heads may be controlled by a user by fitting the second bullet head control plates 44 between the pairs of second holding brackets 43 or removing the second bullet head control plates 44 therefrom depending on the kind of bullet head or bullet. The second bullet head control plates 44 serve to fulfill a function of additionally absorbing the force of impact of bullet heads, in addition to the absorption of the force of impact obtained by the buffer unit 30.

By further absorbing the force of impact of a bullet head, which has passed through the buffer unit 30 and has entered the rear part of the case 10, by the second bullet head control plates 44, the bullet head is collected in the case 10 without penetrating the rear wall of the case 10.

The bullet head impact control unit 40 further includes a bullet head-blocking plate 45, which is made of a metal material and is releasably fitted between the pair of second holding brackets 43 behind the second bullet head control plate 44. The bullet head-blocking plate 45, which is made of a metal plate capable of blocking a bullet head having a decreased force of impact, serves to completely block the movement of a bullet head that has passed through the second bullet head control plate 44, so as to prevent the bullet head from colliding with the rear wall of the case 10.

The bullet head-collecting apparatus according to the embodiment further includes a target attaching plate 50, which is made of a flexible material and is attached to the front surface of the bullet head impact control unit 40 so as to close the open front face of the case 10. The target attaching plate 50 is intended to enable a paper target to be attached to the open front face of the case 10. The target attaching plate 50 is preferably made of a porous material having high toughness and flexibility, and two paper targets are usually attached to the target attaching plate 50.

The bullet head-collecting apparatus according to the embodiment further includes a collecting drawer 60, which is slidably mounted on a support frame 61 installed at the lower face of the case 10 so as to collect bullet heads dropping through the discharge openings 13, and a plurality of legs 70 coupled to the support frame 61.

The collecting drawer 60, which is slidably mounted on the lower face of the case 10 by means of the support frame 61, is intended to collect bullet heads, which are collected in the case 10 and are discharged downward from the case 10 through the discharge openings 13. The legs 70 serve to space the case 10 apart from the ground so as to ensure convenient shooting.

The procedure of using the bullet head-collecting apparatus having the above-described construction will now be described. After the bullet head-collecting apparatus according to the embodiment is first installed at a shooting range, a paper target is attached to the target attaching plate 50, and shooting is then performed.

When a bullet head, which has been fired from a gun, enters the case 10 through the paper target and the target attaching plate 50, the force of impact of the bullet head is first absorbed by the first bullet head control plate 42. The force of impact of the bullet head is almost completely absorbed while the bullet head passes through the buffer unit 30.

The force of impact of the bullet head, which is absorbed by the buffer unit 30 while the bullet head passes through the buffer unit 30, is appropriately distributed through the first through holes 11 and the second through holes 21.

As the bullet head, which has passed through the buffer unit 30, passes through the second bullet head control plate 44, the remaining force of impact of the bullet head is completely absorbed by the second bullet head control plate 44, whereby the bullet head drops to the bottom the case 10. The bullet head, which has dropped to the bottom of the case 10, is collected in the collecting drawer 60 through the discharge openings 13.

Here, a user controls the extent of absorption of the force of impact so as to collect bullet heads appropriately and efficiently by adjusting the numbers of the first bullet head control plate 42 and the second bullet head control plate 44 appropriately for the kind of bullet head or bullet.

Figure 6:
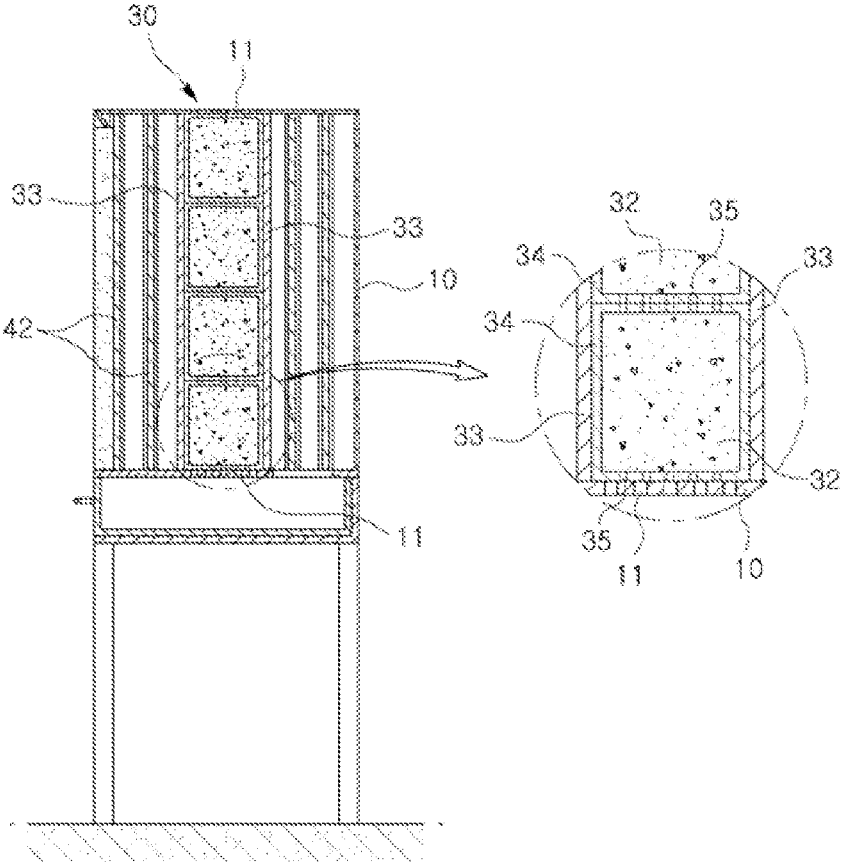
FIG. 6 is a schematic side cross-sectional view of a bullet head-collecting apparatus according to a second embodiment of the present invention.
Figure 7:
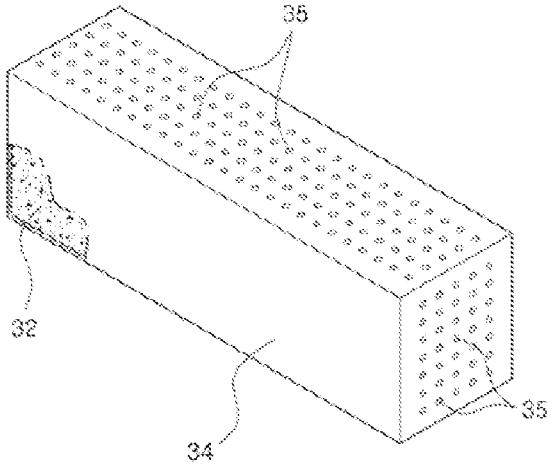
FIG. 7 is a perspective view of a substantial part of the second embodiment shown in FIG. 6, which is partially broken away.

As shown in FIGS. 6 and 7, the buffer unit 30 of the bullet head-collecting apparatus according to a second embodiment includes a pair of second fixed plates 33, which are mounted on the inner surface of the case 10 and are spaced apart from each other, and a plurality of hexahedral buffer blocks 34, which are removably stacked between the pair of second fixed plates 33 and which are filled with the filler 32.

The second fixed plates 33 define therebetween a space in which the buffer blocks 34 containing the filler 32 are removably stacked. The second fixed plates 33, which fulfill such a function, are internally attached to the lateral side surfaces of the case 10 through welding or are mounted on the lateral side surfaces of the case 10 by means of brackets.

Since the buffer blocks 34, which are filled with the filler 32, are removably disposed between the second fixed plates 33, the buffer blocks 34 may be replaced with fresh ones when they are damaged by bullet heads, whereby the service life of the bullet head-collecting apparatus according to the embodiment may be remarkably extended.

The filler 32, which serves to hold bullet heads introduced into the buffer blocks 34 and to absorb the force of impact of the bullet heads, includes rubber chips, sand, metal powder and water absorption agent, as described above.

Each of the buffer blocks 34 includes a plurality of through holes 35 formed in the upper and lower walls thereof. The through holes 35 serve to distribute the force of impact, which is transmitted to the filler 32 of the buffer block 34 from a bullet head passing through the buffer block 34.

Furthermore, the through holes 35 serve to allow relatively fine particulate filler 32 such as metal powder to be additionally charged in the buffer block 34 by a user.

Figure 8:
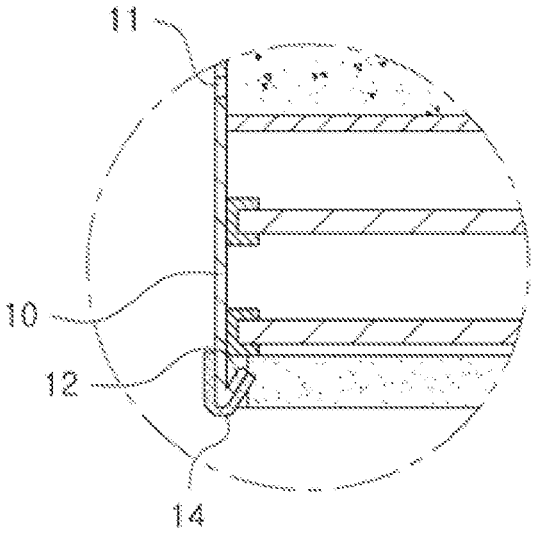
FIG. 8 is an enlarged plan cross-sectional view of a substantial part of a bullet head-collecting apparatus according to a third embodiment of the present invention.
Figure 9:
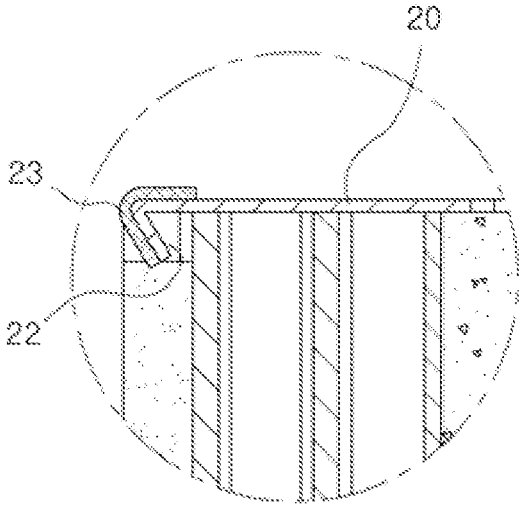
FIG. 9 is an enlarged side cross-sectional view of a substantial part of the bullet head-collecting apparatus according to the third embodiment of the present invention.

As shown in FIGS. 8 and 9, the case 10 of the bullet head-collecting apparatus according to a third embodiment of the present invention further includes a pair of side bulletproof covers 14, which are made of a bulletproof material and are attached to both lateral side walls of the case 10 so as to cover the side guide ribs 12. The cover plate 20 further includes an upper bulletproof cover 23, which is made of a bulletproof material and is attached to the upper surface of the cover plate 20 so as to cover the upper guide rib 22.

The side bulletproof covers 14, which are made of a bulletproof material, which prevents a bullet head from penetrating therethrough, serve to protect portions of the lateral side walls and the side guide ribs 12 from bullet heads so as not to be penetrated by bullet heads.

Like the side bulletproof covers 14, the upper bulletproof cover 23, which is also made of a bulletproof material, serves to protect a portion of the upper wall of the cover plate 20 and the upper guide rib 22 from a bullet head so as not to be penetrated by a bullet head.

Figure 10:
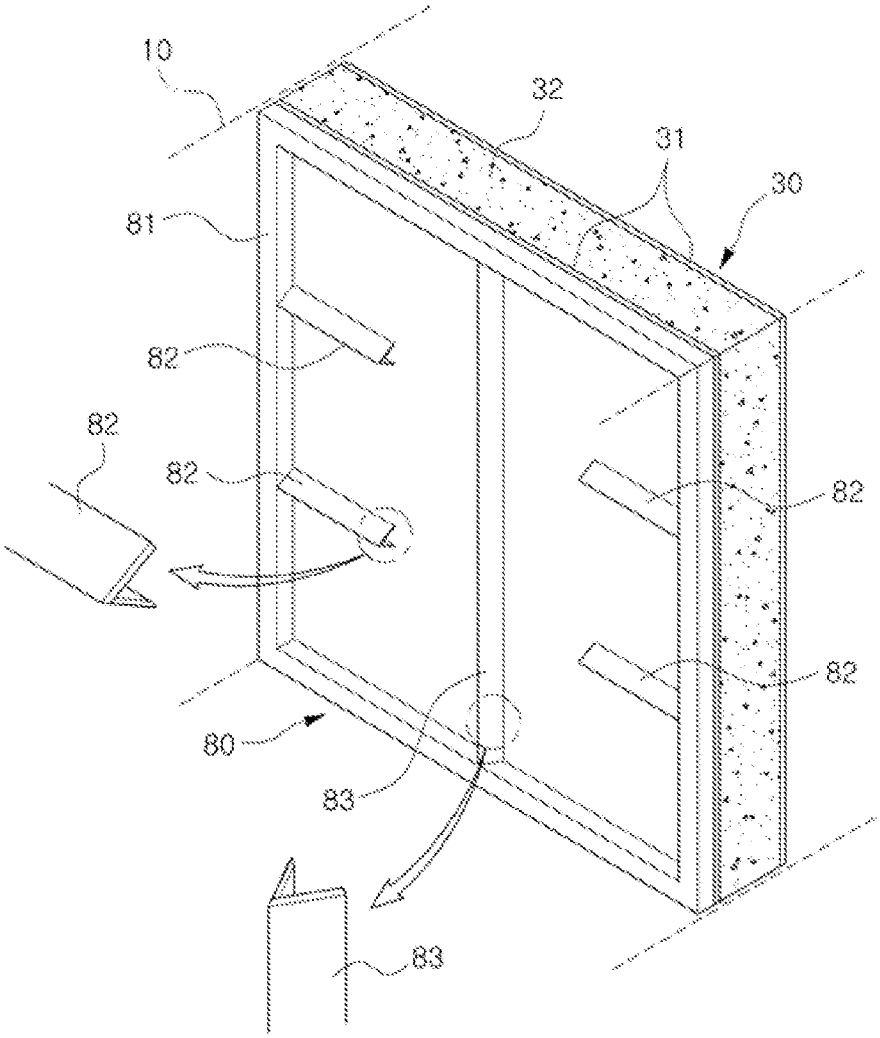
FIG. 10 is a perspective view of a substantial part of a bullet head-collecting apparatus according to a fourth embodiment of the present invention.
Figure 11:
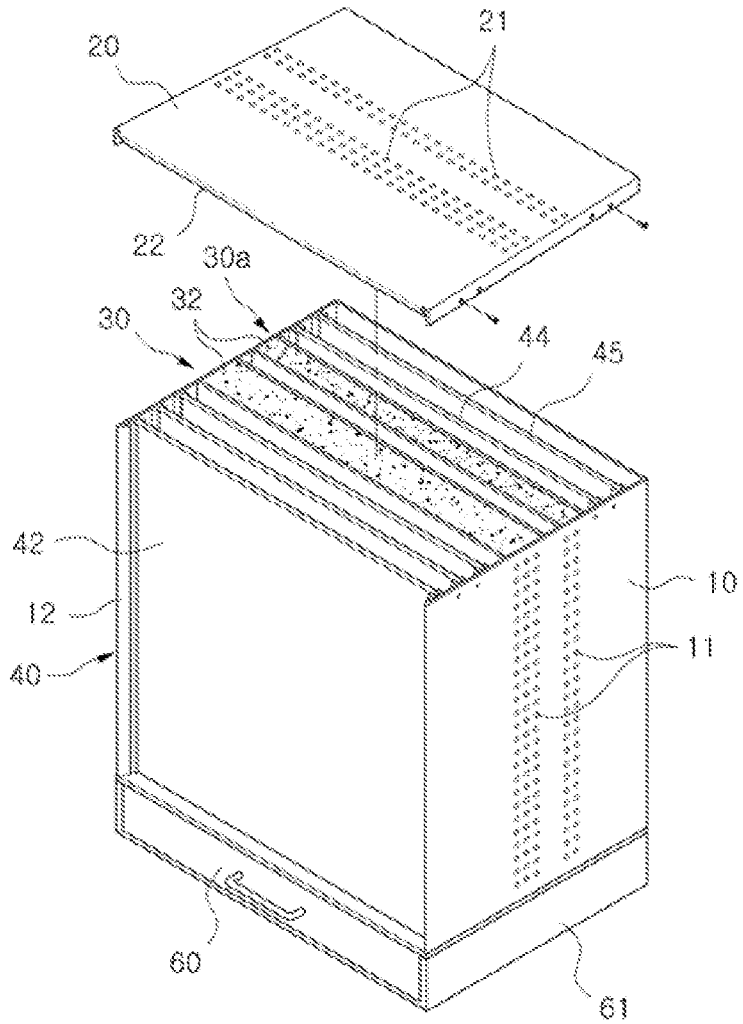
FIG. 11 is a partially exploded perspective view of a bullet head-collecting apparatus according to a fifth embodiment of the present invention.
Figure 12:
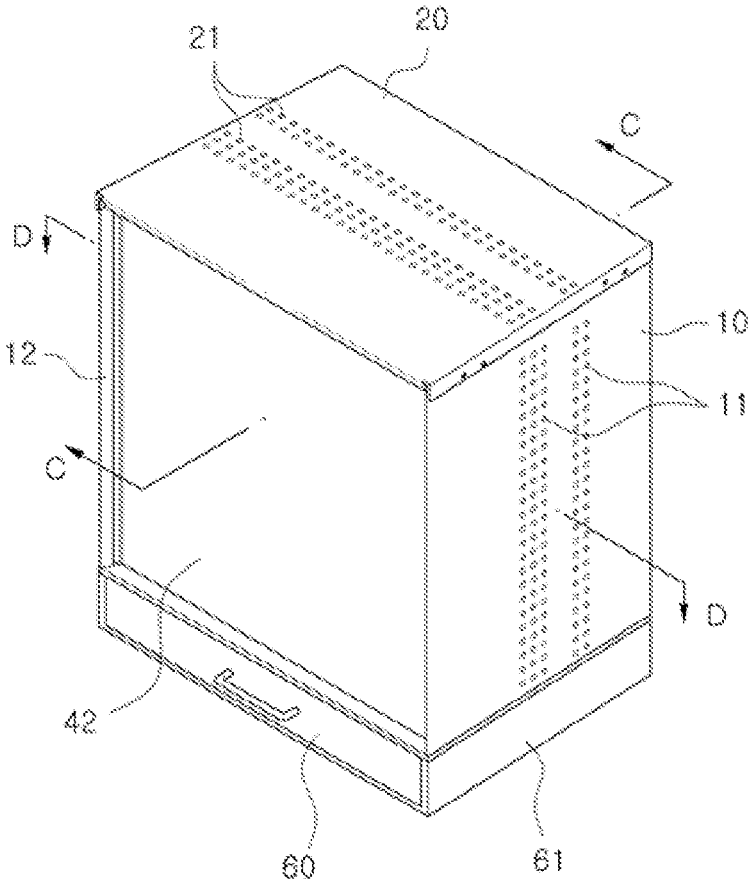
FIG. 12 is an assembled perspective view of the bullet head-collecting apparatus according to the fifth embodiment of the present invention.
Figure 13:
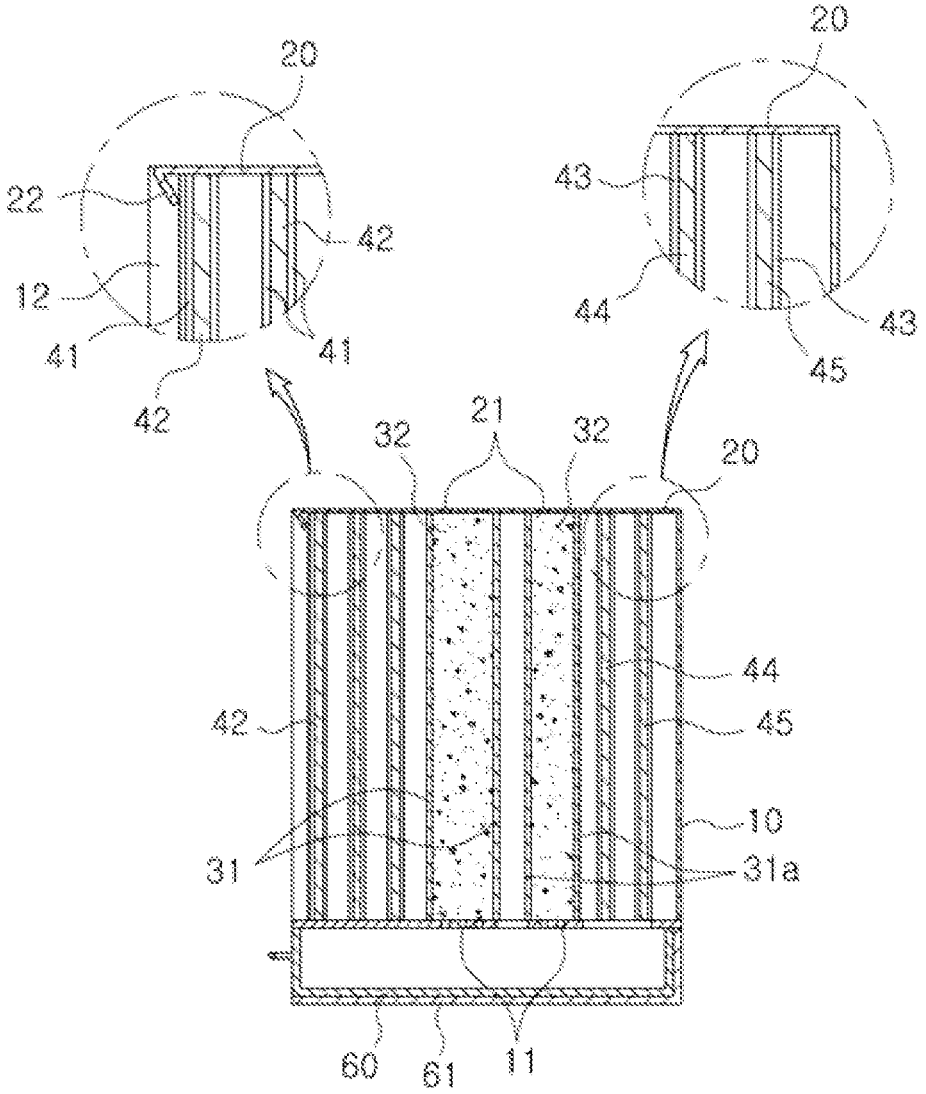
FIG. 13 is a schematic cross-sectional view taken along line C-C of FIG. 12.
Figure 14:
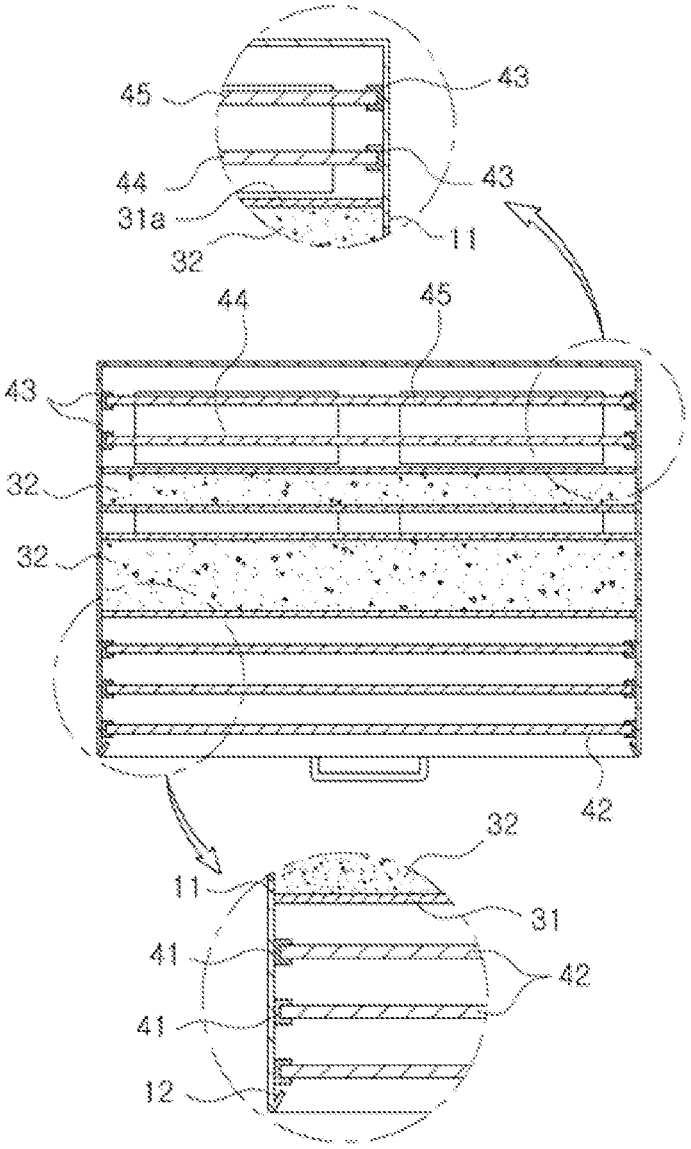
FIG. 14 is a schematic cross-sectional view taken along line D-D of FIG. 12.
Figure 15:
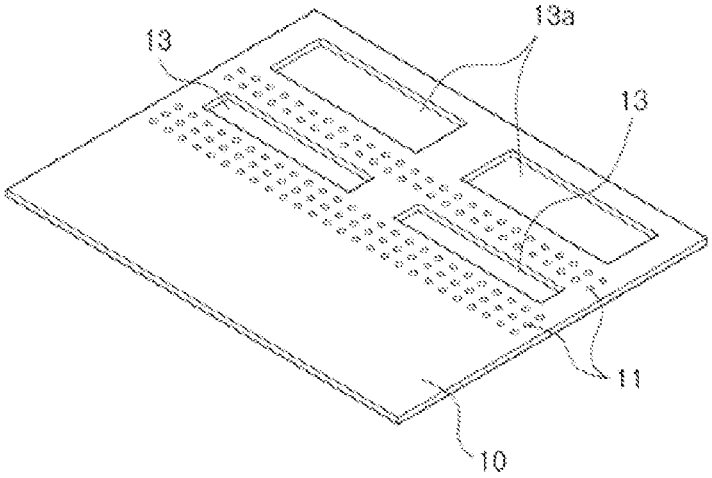
FIG. 15 is a perspective view showing a lower wall of a case of the bullet head-collecting apparatus according to the fifth embodiment of the present invention.

As shown in FIG. 10, the bullet head-collecting apparatus according to a fourth embodiment of the present invention further includes a support unit 80, which is mounted on the front surface of the buffer unit 30 in the case 10. The support unit 80 supports the front surface of the buffer unit 30 so as to prevent deformation of the buffer unit 30, such as swelling.

The support unit 80, which fulfills such a function, includes a rectangular frame 81, which is closely mounted on the periphery of the front surface of the buffer unit 30, horizontal supports 82, which are attached to both lateral sides of the rectangular frame 81 such that they extend horizontally and inwardly and have ridges that protrude forward, and a vertical support 83, which is disposed between the upper and lower ends of the rectangular frame 81 and is attached thereto and which has a ridge that protrudes forward.

The rectangular frame 81, which is secured in the case 10, serves as a support frame for supporting the horizontal supports 82 and the vertical support 83 and for allowing the horizontal supports 82 and the vertical support 83 to be attached thereto.

The horizontal supports 82, which serve to horizontally support the front surface of the buffer unit 30, include a plurality of horizontal supports 82, which are attached at outer ends thereof to both lateral side columns of the rectangular frame 81 in a horizontal orientation. Although the vertical support 82, which serves to support the front surface of the buffer unit 30 in a vertical orientation, is illustrated in FIG. 10 as being a single vertical support, the number of vertical supports 82 may be increased to various numbers.

The ridges of the horizontal supports 82 and the vertical support 83 are positioned so as to protrude forward. Accordingly, even if a bullet head collides with the horizontal supports 82 and the vertical support 83, damage to the horizontal supports 82 and the vertical support 83 due to the bullet head is minimized.

As shown in FIGS. 11 to 15, the bullet head-collecting apparatus according to a fifth embodiment of the present invention includes a case 10, a cover plate 20 covering the case 10, a buffer unit 30 disposed in the case 10, a second buffer unit 30*a* disposed in the case 10 behind the buffer unit 30, and a bullet head impact control unit 40 disposed in the case 10 near the buffer unit 30 and the second buffer unit 30*a*.

The case 10 further includes a plurality of first through holes 11 formed in the regions of both lateral side walls and the lower wall of the case 10 that are in close contact with the buffer unit 30 and the second buffer unit 30*a*. The first through holes 11 serve to efficiently distribute the force of impact applied to the buffer unit 30 and the second buffer unit 30*a* by bullet heads.

The case 10 further includes discharge openings 13 formed in the lower wall of the case behind the buffer unit 30, and second discharge openings 13*a* formed in the lower wall of the case 10 behind the second buffer unit 30*a*. The discharge openings 13 serve as outlets through which bullet heads collected in the case 10 between the buffer unit 30 and the second buffer unit 30*a* are discharged downwards from the case 10, and the second discharge openings 13*a* serve as outlets through which bullet heads collected in the case 10 behind the second buffer unit 30*a* are discharged downwards from the case 10.

The second buffer unit 30*a*, which is disposed in the case 10 so as to be spaced apart from the buffer unit 30, serves to secondarily absorb the force of impact of a bullet head introduced into the case 10.

The second buffer unit 30*a*, which fulfills this function, includes a pair of third fixed plates 31*a*, which are attached to the inner surface of the case 10 and are spaced apart from each other and filler 32 charged between the pair of third fixed plates 31*a* so as to absorb the force of impact of a bullet head. The pair of third fixed plates 31*a* define therebetween a space which is filled with the filler 32. The pair of third fixed plates 31*a*, which fulfill such a function, are internally attached to the lateral side surfaces of the case 10 or are mounted on the lateral side surfaces of the case 10 by means of brackets.

The filler 32, which serves to hold bullet heads introduced into the case 10 through the third fixed plates 31*a* and to absorb the force of impact of the bullet heads, is made of the same material as the filler 32 charged between the pair of first fixed plates 31.

The procedure of using the bullet head-collecting apparatus having the above-described construction will now be described. The bullet head-collecting apparatus is first installed behind a paper target, which is positioned at, for example, a distance of 100 m, 150 m, 200 m or 250 m, and shooting is performed.

When a bullet head, which has been fired from a gun, is introduced into the case 10 through the paper target, the force of impact of the bullet head is first absorbed by the first bullet head control plate 42. The force of impact of the bullet head is almost completely absorbed while the bullet head passes through the buffer unit 30. The bullet head drops to the bottom of the case 10, and is collected in the collecting drawer 60 through the discharge openings 13.

The force of impact of the bullet head, which is absorbed by the buffer unit 30 while the bullet head passes through the buffer unit 30, is appropriately distributed through the first through holes 11 and the second through holes 21.

A bullet head, which has a relatively large diameter or high force of impact, penetrates both the buffer unit 30 and the second buffer unit 30*a*, and then penetrates the second bullet head control plate 44 while its force of impact is completely absorbed by the second bullet head control plate 44. After passing through the second bullet head control plate 44, the bullet head drops in the case 10. The bullet head, which has dropped to the bottom of the case 10, is collected in the collecting drawer 60 through the second discharge openings 13*a*.

Here, a user may control the extent of absorption of the force of impact so as to collect bullet heads appropriately and efficiently by adjusting the numbers of the first bullet head control plate 42 and the second bullet head control plate 44 depending on the kind of bullet head or bullet being used.

Figure 16:
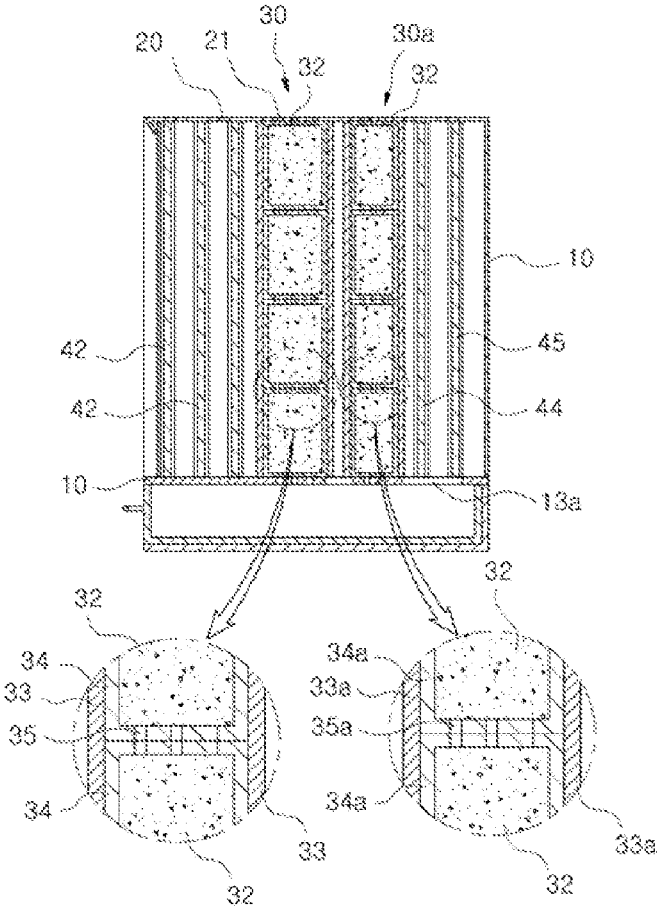
FIG. 16 is a schematic side cross-sectional view of a bullet head-collecting apparatus according to a sixth embodiment of the present invention.
Figure 17:
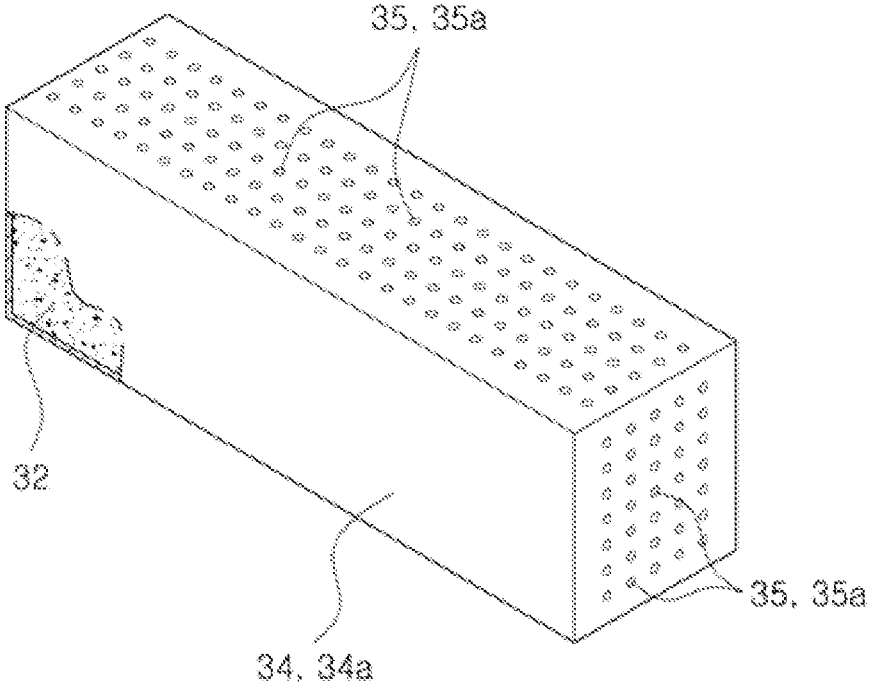
FIG. 17 is a perspective view of a substantial part of the sixth embodiment shown in FIG. 16, which is partially broken away.

As shown in FIGS. 16 and 17, the buffer unit 30 of the bullet head-collecting apparatus according to a sixth embodiment of the present invention includes a pair of second fixed plates 33, which are mounted on the inner surface of the case 10 and are spaced apart from each other, and a plurality of hexahedral buffer blocks 34, which are removably stacked between the pair of second fixed plates 33 and which are filled with the filler 32.

The second buffer unit 30*a* includes a pair of fourth fixed plates 33*a*, which are mounted on the inner surface of the case 10 and are spaced apart from each other, and a plurality of second hexahedral buffer blocks 34*a*, which are removably stacked between the pair of fourth fixed plates 33*a* and which are filled with the filler 32.

The fourth fixed plates 33*s* define therebetween a space in which the second buffer blocks 34*s* containing the filler 32 are removably stacked. The fourth fixed plates 33*a*, which fulfill such a function, are internally attached to the lateral side surfaces of the case 10 or are mounted on both lateral side surfaces of the case 10 by means of brackets.

Since the second buffer blocks 34*a*, which are filled with the filler 32, are removably disposed between the fourth fixed plates 33*a*, the second buffer blocks 34*a* may be replaced with fresh ones when they are damaged by bullet heads, whereby the service life of the bullet head-collecting apparatus is remarkably extended.

The filler 32, which serves to hold bullet heads introduced into the buffer blocks 34 or the second buffer blocks 34*a* and to absorb the force of impact of the bullet heads, includes rubber chips, sand, metal powder and water absorption agent, as described above.

The buffer unit 30 further includes a plurality of through holes 35 formed in the upper and lower walls of the buffer blocks 34, and the second buffer unit 30*a* further includes a plurality of through holes 35*a* formed in the upper and lower walls of the second buffer blocks 34*a*.

The first through holes 35 and the second through holes 35*a* serve to distribute the force of impact, which is transmitted to the filler 32 in the buffer blocks 34 or the second buffer blocks 34*a* by a bullet head passing through the buffer blocks 34 or the second buffer blocks 34*a*.

Figure 18:
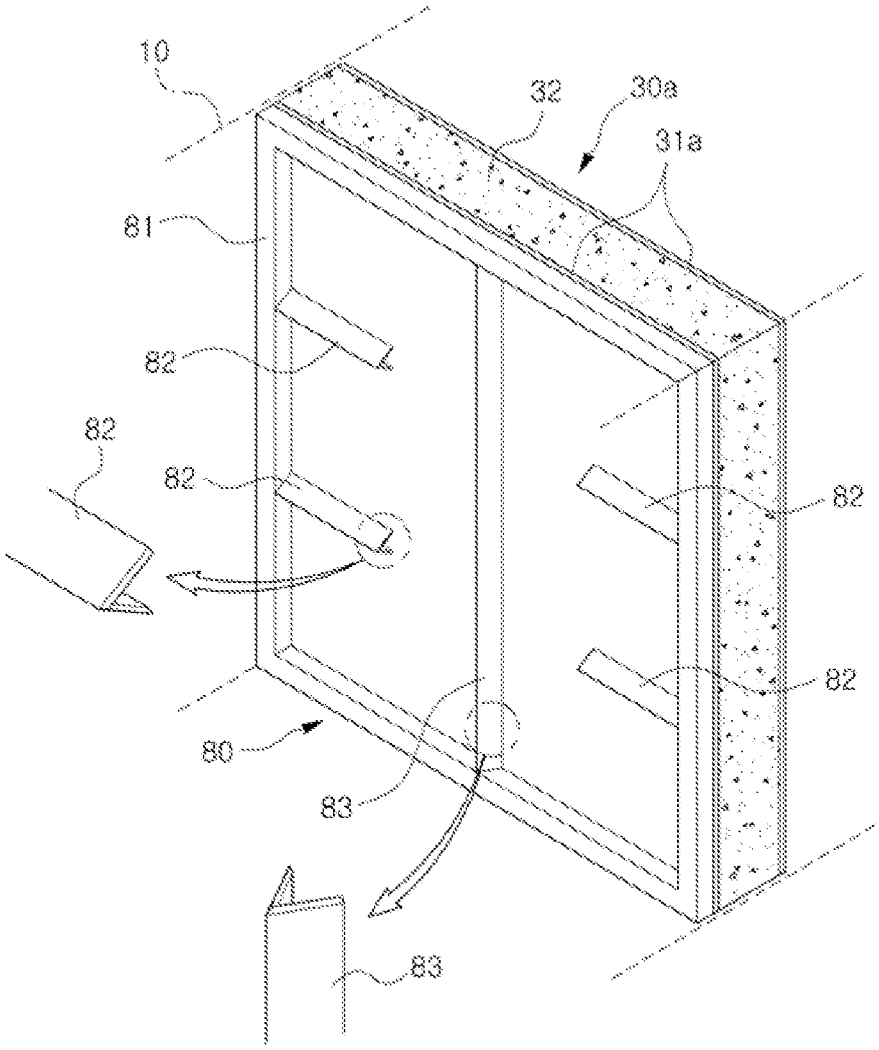
FIG. 18 is a perspective view of a substantial part of a bullet head-collecting apparatus according to a seventh embodiment of the present invention.

As shown in FIG. 18, the bullet head-collecting apparatus according to a seventh embodiment of the present invention further includes a support unit 80, which is mounted on the front surface of the second buffer unit 30*a* in the case 10.

The support unit 80 supports the front surface of the second buffer unit 30*a* so as to prevent deformation of the second buffer unit 30*a*, such as swelling.

The support unit 80, which fulfills such a function, has the same structure as that of the support unit mounted on the front surface of the buffer unit.

Figure 19:
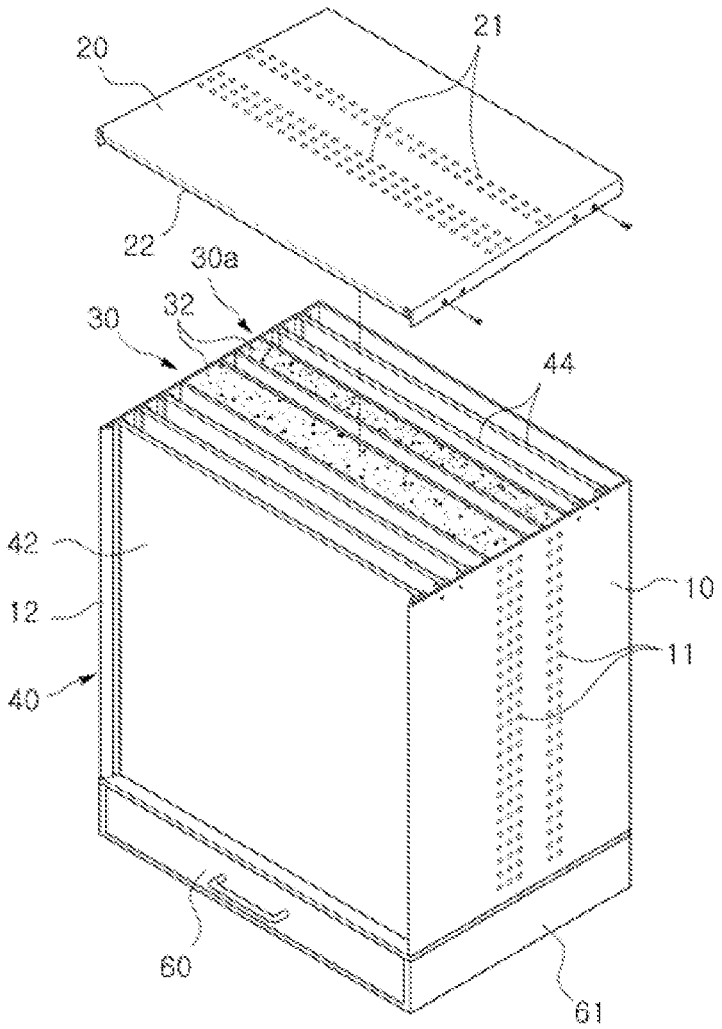
FIG. 19 is a partially exploded perspective view of a bullet head-collecting apparatus according to an eighth embodiment of the present invention.
Figure 20:
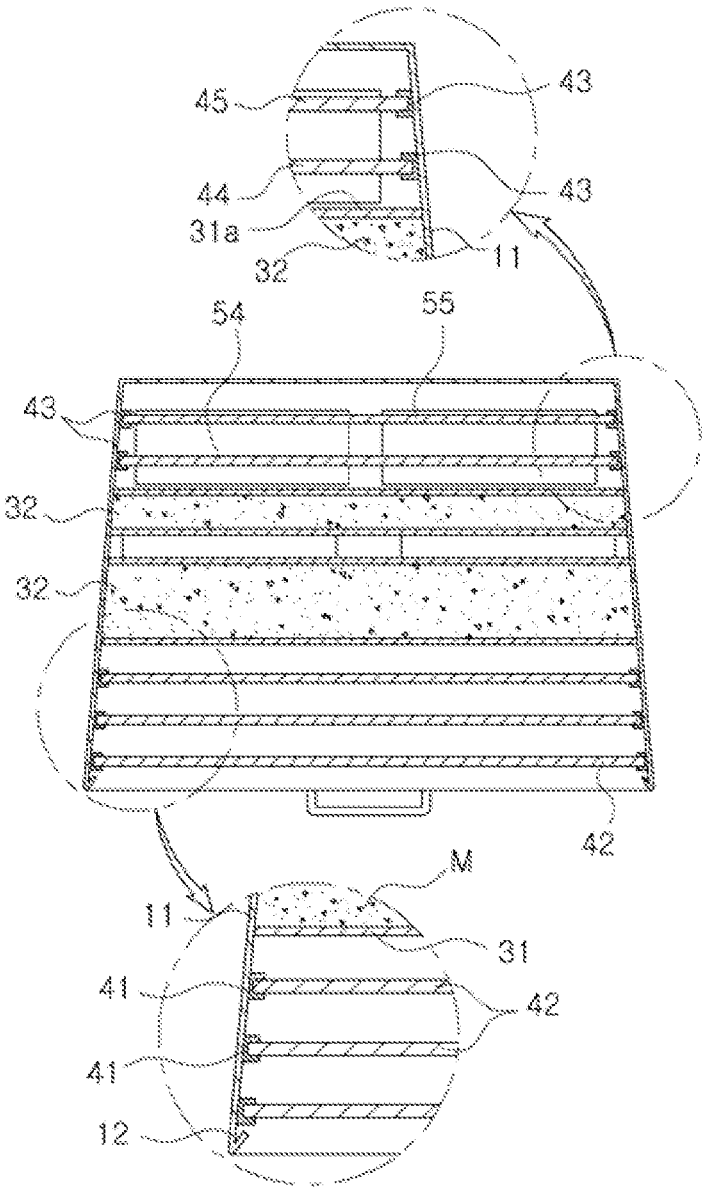
FIG. 20 is a schematic plan cross-sectional view of the bullet head-collecting apparatus according to the eighth embodiment of the present invention.
Figure 21:
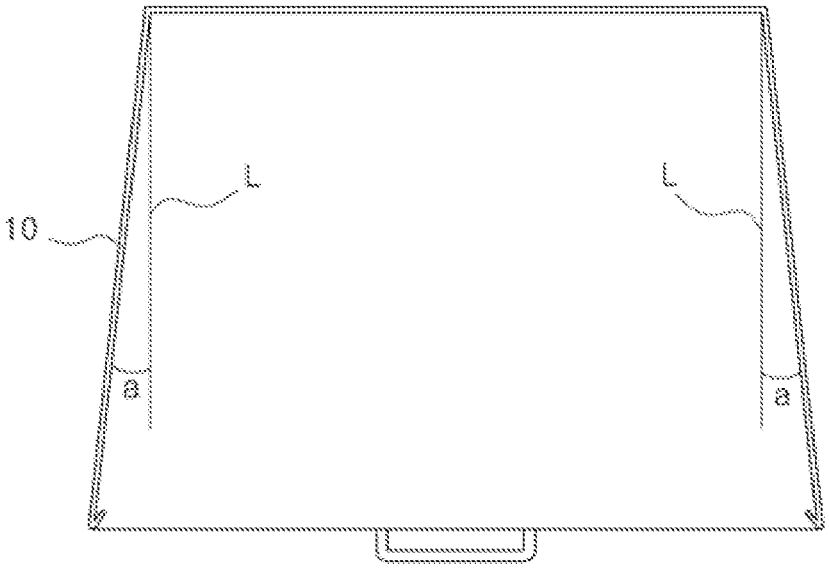
FIG. 21 is a schematic cross-sectional view of a substantial part of FIG. 20.
Figure 22:
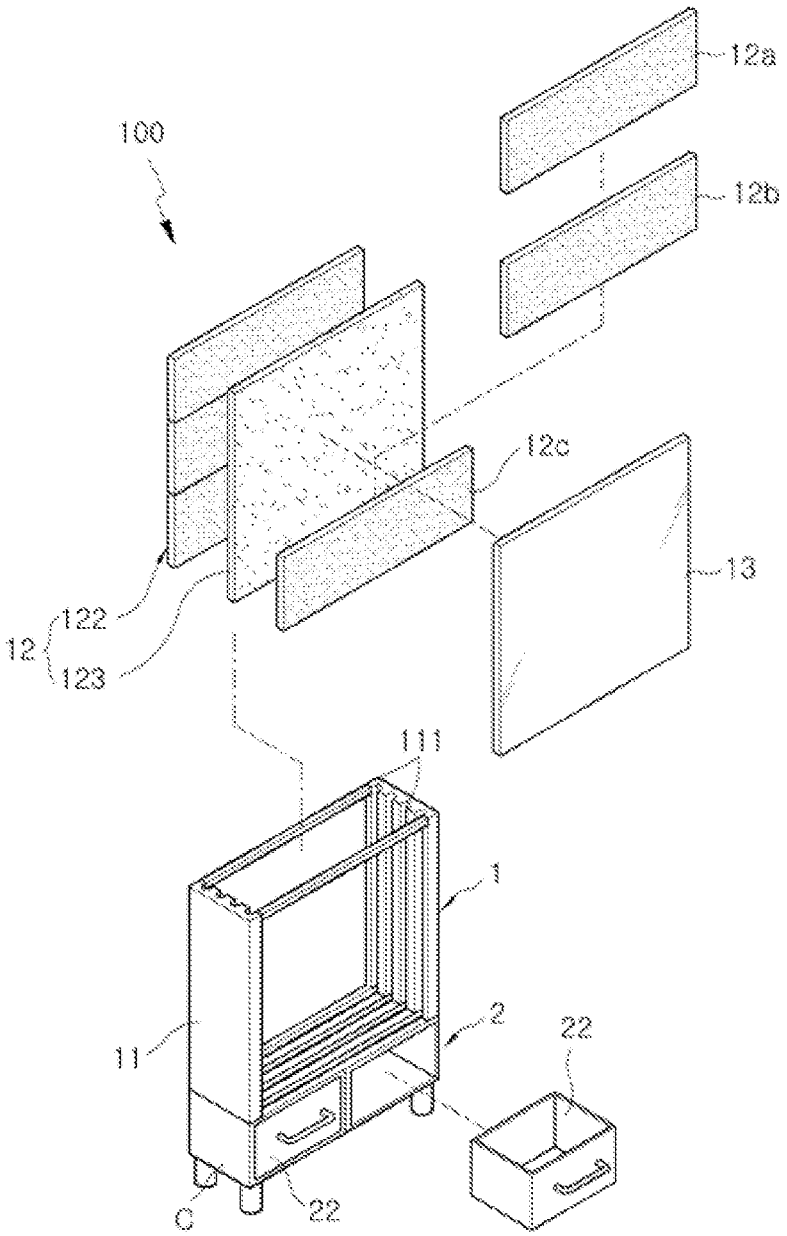
FIG. 22 is an exploded perspective view showing a conventional bullet head-collecting apparatus.
Figure 23:
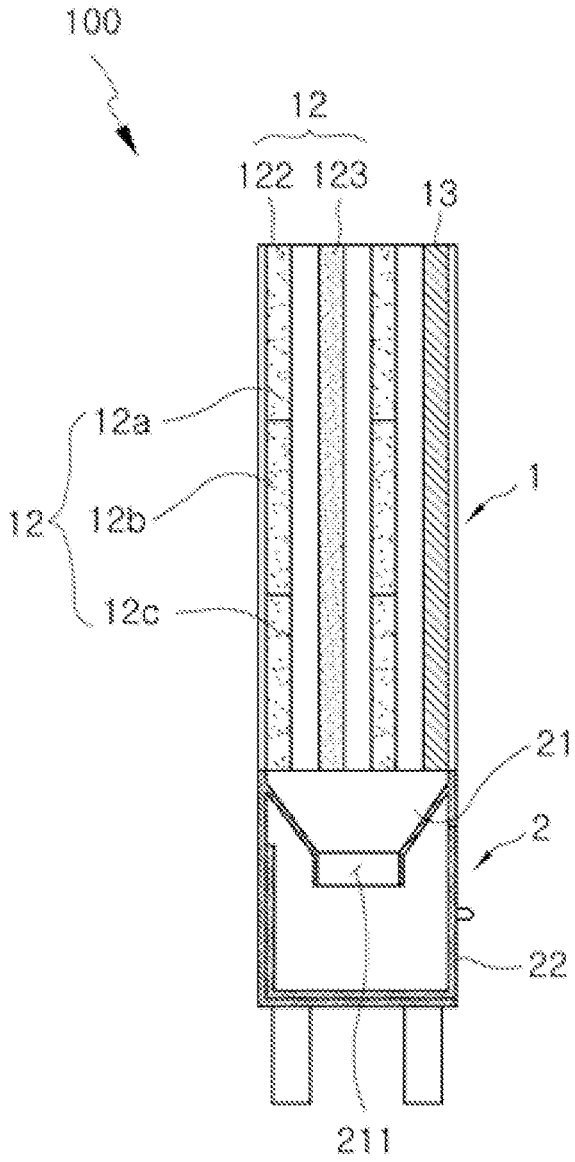
FIG. 23 is an assembled side cross-sectional view of the conventional bullet head-collecting apparatus.

As shown in FIGS. 19 to 21, the bullet head-collecting apparatus according to an eighth embodiment of the present invention includes a case 10, a cover plate 20 covering the case 10, a buffer unit 30 disposed in the case 10, a second buffer unit 30*a* disposed in the case 10 behind the buffer unit 30, and a bullet head impact control unit 40 disposed in the case 10 near the buffer unit 30 and the second buffer unit 30*a*.

The case 10 is configured to have a hexahedral shape with open upper and front faces, in which the width of the front face is greater than that of the rear face so as to have a shape which is wider at a front thereof. The case 10 provides a space for accommodating various components including the buffer unit 30 and serves to collect bullet heads, which are shot horizontally and introduced thereinto. The case 10, which fulfills such as function, is preferably made of metal plates that cannot be perforated by bullet heads.

Specifically, the case 10 is configured to be wider at a front thereof so as to efficiently collect therein bullet heads which are shot from various angles during combat target practice, in which shooting is performed while a user moves. The angle (a) between a straight line L which extends perpendicularly forward from the rear end of the lateral side wall and the lateral side wall of the case 10 is preferably in a range of 5 to 15 degrees.

If the angle of inclination (a) of the lateral side wall of the case 10 is smaller than 5 degrees, it is impossible to efficiently collect bullet heads fired at various angles during combat target practice. If the angle of inclination (a) of the lateral side wall of the case 10 is greater than 15 degrees, it is impossible to suitably configure the shape of the target, because the front face is excessively widened.

The cover plate 20, which is removably mounted on the open upper face of the case 10, is constituted by a trapezoidal plate, and is closely mounted on the open upper face of the case 10 so as to open and close the upper face of the case 10. In other words, the cover plate 20 may be separated from the case 10 as desired by a user so as to open the case 10, thereby allowing a user to easily control the extent to which the force of impact of a bullet head is absorbed by means of the bullet head impact control unit 40.

The invention claimed is:

1. A bullet head-collecting apparatus comprising:

a case configured to have a hexahedral shape with open front and upper faces;

a cover plate removably mounted on the open upper face of the case;

a buffer unit disposed in the case so as to absorb a force of impact of a bullet head; and a bullet head impact control unit which includes at least one pair of first fixed brackets internally mounted on both lateral side surfaces of the case in front of the buffer unit and at least one first bullet head control plate removably fitted into the pair of first fixed brackets, wherein the buffer unit comprises:

a pair of fixed plates which are attached to an inner surface of the case and are spaced apart from each other; and one or more hexahedral buffer blocks which are removably stacked between the pair of fixed plates and are filled with a filler, and wherein the buffer unit further includes a plurality of through holes formed in upper and lower walls of the buffer blocks, wherein the filler includes rubber chips, sand, metal powder and water absorption agent, wherein the case includes a plurality of first through holes formed in regions of both lateral side walls and a lower wall of the case that are in close contact with the buffer unit, wherein the cover plate includes a plurality of second through holes formed in a region thereof that is in close contact with the buffer unit.

2. The bullet head-collecting apparatus according to claim 1, wherein the bullet head impact control unit comprises:

at least one pair of second fixed brackets internally mounted on both lateral side surfaces of the case behind the buffer unit;

at least one second bullet head control plate removably fitted into the pair of second fixed brackets; and a bullet head-blocking plate which is made of a metal material and is removably fitted in the pair of second fixed brackets behind the second bullet head control unit.

3. The bullet head-collecting apparatus according to claim 1, further comprising a target attaching plate which is made of a flexible material and is attached to a front surface of the bullet head impact control unit disposed at the open front face of the case.

4. The bullet head-collecting apparatus according to claim 1, wherein the case includes a discharge opening formed in a lower wall of the case behind the buffer unit, wherein the bullet head-collecting apparatus further comprises:

a collecting drawer slidably mounted on a support frame disposed at the lower wall of the case; and a plurality of legs mounted on the support frame.

5. A bullet head-collecting apparatus comprising:

a case configured to have a hexahedral shape with open front and upper faces;

a cover plate removably mounted on the open upper face of the case;

a buffer unit disposed in the case so as to absorb a force of impact of a bullet head; and a bullet head impact control unit which includes at least one pair of first fixed brackets internally mounted on both lateral side surfaces of the case in front of the buffer unit and at least one first bullet head control plate removably fitted into the pair of first fixed brackets, wherein the buffer unit comprises:

a pair of fixed plates which are attached to an inner surface of the case and are spaced apart from each other; and one or more hexahedral buffer blocks which are removably stacked between the pair of fixed plates and are filled with a filler, wherein the case includes side guide ribs which are symmetrically disposed at front ends of both lateral side walls of the case and are inclined inwardly, wherein the cover plate includes an upper guide rib which is disposed at the front end of the cover plate and is inclined inwardly, wherein the case further includes a pair of side bulletproof covers which are symmetrically attached to the both lateral side walls of the case so as to cover the side guide ribs, and wherein the cover plate further includes an upper bulletproof cover attached to an upper wall of the cover plate so as to cover the upper guide rib.

6. A bullet head-collecting apparatus comprising:

a case configured to have a hexahedral shape with open front and upper faces;

a cover plate removably mounted on the open upper face of the case;

a buffer unit disposed in the case so as to absorb a force of impact of a bullet head; and a bullet head impact control unit which includes at least one pair of first fixed brackets internally mounted on both lateral side surfaces of the case in front of the buffer unit and at least one first bullet head control plate removably fitted into the pair of first fixed brackets, wherein the buffer unit comprises:

a pair of fixed plates which are attached to an inner surface of the case and are spaced apart from each other; and one or more hexahedral buffer blocks which are removably stacked between the pair of fixed plates and are filled with a filler, wherein the apparatus further comprises a support unit which is disposed on a front surface of the buffer unit in the case so as to support the front surface of the buffer unit, and wherein the support unit comprises:

a rectangular frame which is closely mounted on a periphery of the front surface of the buffer unit;

a horizontal support which is attached to both lateral sides of the rectangular frame such that they extend horizontally and inwardly and have ridges protruding forward; and a vertical support which is attached between upper and lower ends of the rectangular frame and which has a ridge protruding forward.

7. A bullet head-collecting apparatus comprising:

a case configured to have a hexahedral shape with open front and upper faces;

a cover plate removably mounted on the open upper face of the case;

a buffer unit disposed in the case so as to absorb a force of impact of a bullet head; and a bullet head impact control unit which includes at least one pair of first fixed brackets internally mounted on both lateral side surfaces of the case in front of the buffer unit and at least one first bullet head control plate removably fitted into the pair of first fixed brackets, wherein the buffer unit comprises:

a pair of first fixed plates which are attached to an inner surface of the case and are spaced apart from each other; and one or more hexahedral buffer blocks which are removably stacked between the pair of first fixed plates and are filled with a first filler, wherein the apparatus further comprises a second buffer unit which is disposed in the case and is spaced rearward apart from the buffer unit so as to secondarily absorb a force of impact of a bullet head, and wherein the second buffer unit comprises:

a pair of second fixed plates which are mounted on the inner surface of the case and are spaced apart from each other;

one or more second hexahedral buffer blocks which are removably stacked between the pair of second fixed plates and which are filled with a second filler; and a plurality of second through holes formed in upper and lower walls of the second buffer blocks.

* * * * *